US007349661B2

(12) United States Patent
Cho et al.

(10) Patent No.: US 7,349,661 B2
(45) Date of Patent: Mar. 25, 2008

(54) FUSING ROLLER AND FUSING APPARATUS USING THE SAME

(75) Inventors: Durk-hyun Cho, Suwon-si (KR); Joong-gi Kwon, Gunpo-si (KR); Hwan-guem Kim, Eunpyeong-gu (KR); Young-min Chae, Suwon-si (KR); Sang-yong Han, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/211,564

(22) Filed: Aug. 26, 2005

(65) Prior Publication Data

US 2006/0093414 A1 May 4, 2006

(30) Foreign Application Priority Data

Oct. 29, 2004 (KR) ..... 10-2004-0087060

(51) Int. Cl.
*G03G 15/20* (2006.01)
*B21B 27/06* (2006.01)

(52) U.S. Cl. ..... 399/328; 219/469

(58) Field of Classification Search ..... 399/328, 399/330, 335, 338, 333; 219/469
See application file for complete search history.

(56) References Cited

U.S. PATENT DOCUMENTS

| | | | | |
|---|---|---|---|---|
| 4,329,566 | A | 5/1982 | Hooper | |
| 6,169,871 | B1 * | 1/2001 | Higaya | 399/330 |
| 6,347,201 | B1 * | 2/2002 | Sano et al. | 399/67 |
| 6,571,080 | B2 * | 5/2003 | Lee et al. | 399/330 |
| 6,847,019 | B2 * | 1/2005 | Yokozeki et al. | 219/619 |
| 2002/0118985 | A1 * | 8/2002 | Lee | 399/330 |
| 2003/0053812 | A1 * | 3/2003 | Nakayama | 399/44 |
| 2003/0062363 | A1 * | 4/2003 | Takagi et al. | 219/619 |
| 2004/0120741 | A1 * | 6/2004 | Kim et al. | 399/330 |

FOREIGN PATENT DOCUMENTS

| | | |
|---|---|---|
| EP | 1469356 | 10/2004 |
| EP | 1612620 | 1/2006 |
| EP | 1612621 | 1/2006 |
| JP | 07-325496 | 12/1995 |
| JP | 10-116675 | 5/1998 |
| JP | 2000-321911 | 11/2000 |
| JP | 2001-282025 | 10/2001 |
| JP | 2002-055549 | 2/2002 |
| JP | 2002-174973 | 6/2002 |
| JP | 2002-299032 | 10/2002 |
| JP | 2003-287968 | 10/2003 |
| JP | 2003-316182 | 11/2003 |
| KR | 1020030005551 | 1/2003 |
| KR | 1020040041734 | 5/2004 |

* cited by examiner

*Primary Examiner*—David M. Gray
*Assistant Examiner*—Joseph S. Wong
(74) *Attorney, Agent, or Firm*—Roylance, Abrams, Berdo & Goodman, L.L.P.

(57) ABSTRACT

A fusing roller and a fusing apparatus using the same are provided. The fusing roller includes a coil unit resistance heated by a predetermined alternating current, and generating an alternating magnetic flux by the alternating current. A heating roller unit is heated by an induced current generated by the alternating magnetic flux. An adhering unit is formed of a non-magnetic material and is installed to contact the inside of the coil unit to elastically bias the coil unit toward the heating roller unit to adhere the coil unit onto the heating roller unit.

20 Claims, 5 Drawing Sheets

FUSING ROLLER AND FUSING APPARATUS USING THE SAME

CROSS REFERENCE TO RELATED APPLICATION

This application claims the benefit under 35 U.S.C. § 119(a) of Korean Patent Application No. 10-2004-0087060, filed on Oct. 29, 2004, in the Korean Intellectual Property Office, the entire disclosure of which is hereby incorporated by reference.

BACKGROUND OF THE INVENTION

1. Field of the Invention

The present invention relates to a fusing apparatus. More particularly, the present invention relates to a fusing apparatus including a fusing roller maximizing an induced heating efficiency of a heated substance by adhering a heating unit onto the heated substance using an elastic material to concentrate a magnetic flux on the heated substance.

2. Description of the Related Art

Generally, an image forming apparatus using an electrophotographic method, such as a laser printer or a digital copying machine, prints a mono-color image or a full-color image by forming an electrostatic latent image by scanning light onto a photosensitive medium charged to a predetermined electric potential. The electrostatic latent image is developed using toner of a predetermined color stored in a developing unit. The developed image is transferred and fused onto a sheet of paper.

The electrophotographic image forming apparatus may be classified into a wet type image forming apparatus and a dry type image forming apparatus.

The wet type electrophotographic image forming apparatus uses a developer, which is made by distributing powder toner in a liquid carrier. The dry type electrophotographic image forming apparatus uses a binary developer, in which powder carrier and toner are mixed, or a single developer without the carrier. Hereinafter, the dry type electrophotographic image forming apparatus will be described, and the developer will be referred to as toner.

FIG. 1 is a transversal cross-sectional view of a fusing apparatus using a halogen lamp as a heat source, according to the conventional art. FIG. 2 is a longitudinal cross-sectional view along line I-I' of FIG. 1.

The fusing apparatus 10 includes two cylindrical fusing rollers 11 and 12 formed of aluminum, which contact each other in a lengthwise direction. Both ends of the fusing rollers 11 and 12 are supported by bearings 14. Coating layers 13 are formed on surfaces of the fusing rollers 11 and 12 to form a nip for heating and fusing an image onto a piece of paper passing between the rollers 11 and 12.

A heating unit 15 that uses a halogen lamp as a heat source is connected to an external power source (not shown) to generate heat. The heating unit 15 is installed in each fusing roller 11 or 12. The heating unit 15 is separated from the fusing roller 11 or 12, and air is filled therebetween.

When an electric current from the external power source (not shown) is applied to both ends of the heating unit 15, the heating unit 15 generates radiation energy that is transmitted to inner walls of the fusing rollers 11 and 12 through the air. A light/heat conversion layer formed as a black body converts the radiation energy into heat energy. The heat energy is transmitted to an image 21 on a recording medium 20 that passes through the fusing rollers 11 and 12 that contact each other. Therefore, the image 21 is melted by the heat energy, and fused on the recording medium 20.

However, the fusing apparatus using the halogen lamp as the heat source has the following problems.

When the power source is turned on to perform a printing operation, a long warm-up time is required until the temperature of a fusing roller reaches the fusing temperature from normal temperature. A user should wait until the fusing roller reaches the fusing temperature before performing the printing operation.

Additionally, since the halogen lamp and the fusing roller are separated from each other and air is filled therebetween, the heat generated by the halogen lamp heats the fusing rollers by radiation, and passes through the fusing rollers by conduction. Therefore, the heat transmission speed is low, and heat efficiency is reduced.

Accordingly, a need exists for a fusing roller of a fusing apparatus that reduces the warm-up time and improves heat efficiency.

SUMMARY OF THE INVENTION

The present invention provides a fusing roller that reduces a warm-up time by using induction heating and resistance heating simultaneously and improves heat efficiency by adhering a heating unit to a heated unit using an elastic material, and a fusing apparatus using the fusing roller.

According to an aspect of the present invention, a fusing roller for fusing an image on a sheet of paper includes a coil unit resistance heated by a predetermined alternating current, and an alternating magnetic flux generated by the alternating current. A heating roller unit is heated by an induced current generated by the alternating magnetic flux. An adhering unit is formed of a non-magnetic material and installed to contact the inside of the coil unit to elastically bias the coil unit toward the heating roller unit to adhere the coil unit onto the heating roller unit.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
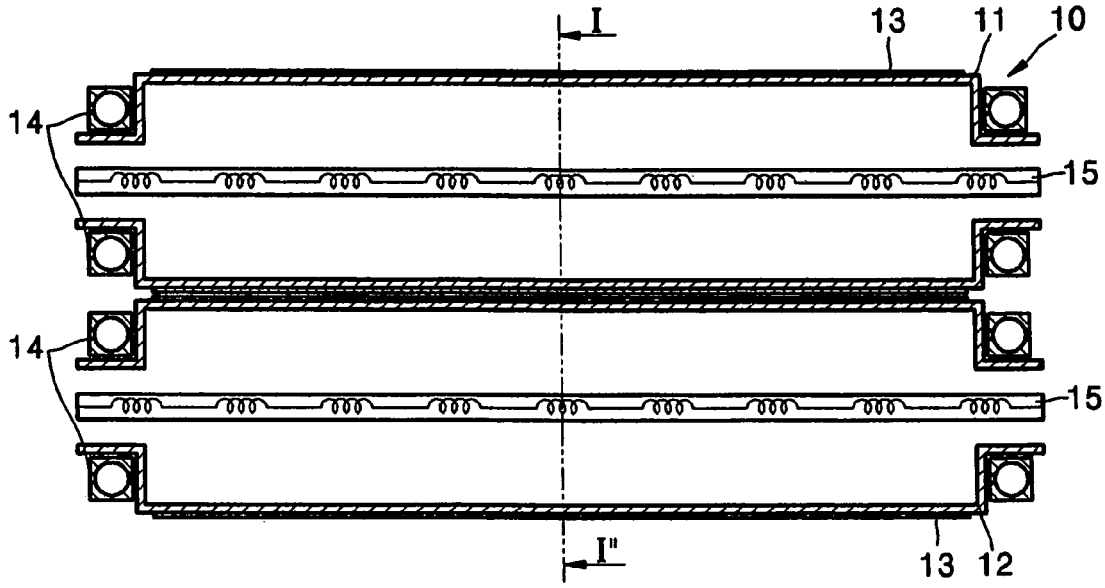
FIG. 1 (PRIOR ART)
FIG. 1 is a transversal cross-sectional view of a fusing apparatus using a halogen lamp as a heat source according to an exemplary embodiment of the conventional art.
Figure 2:
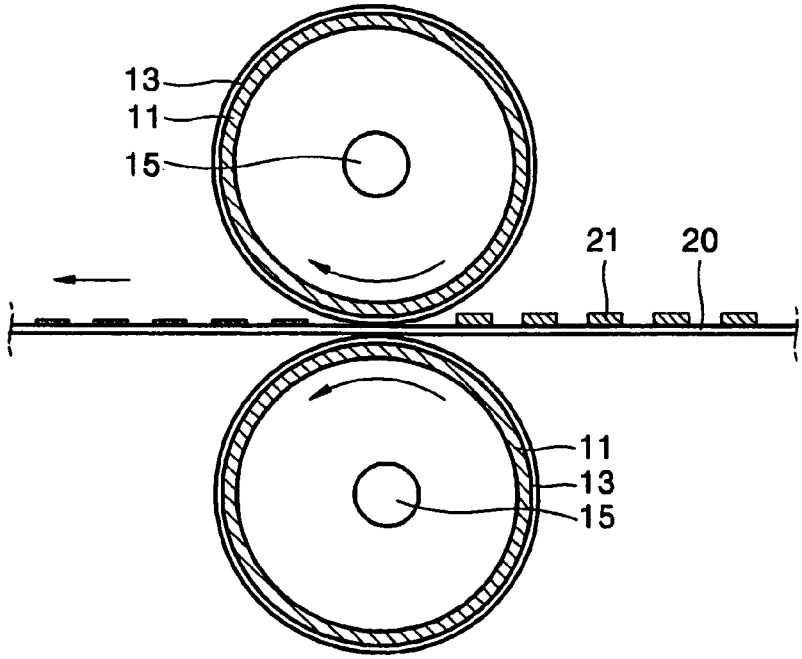
FIG. 2 (PRIOR ART)
FIG. 2 is a longitudinal cross-sectional view along line I-I' of FIG. 1.
Figure 3:
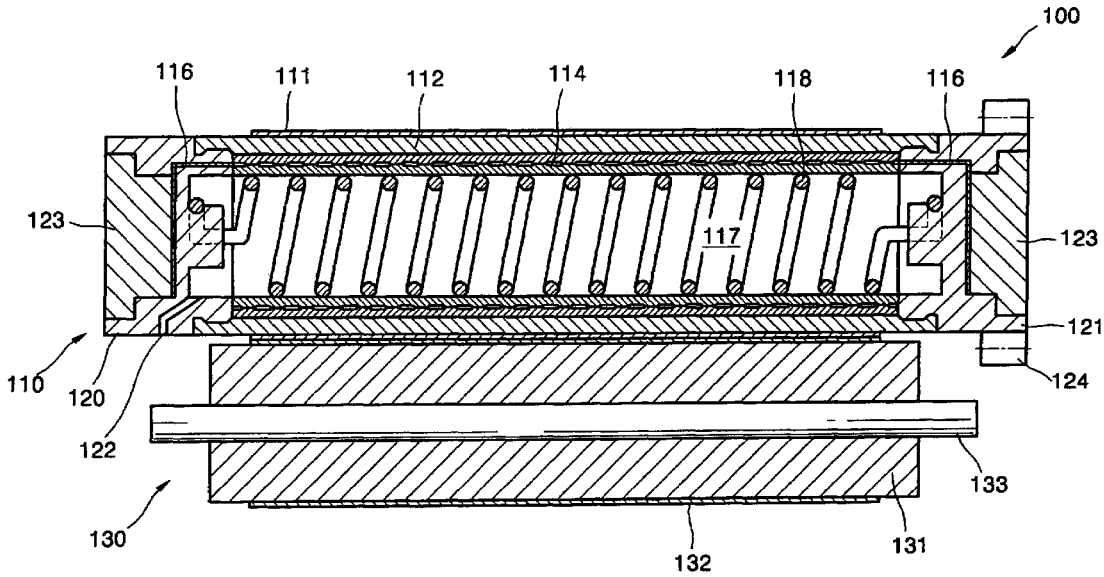
FIG. 3 is a transversal cross-sectional view of a fusing apparatus according to an exemplary embodiment of the present invention.
Figure 4:
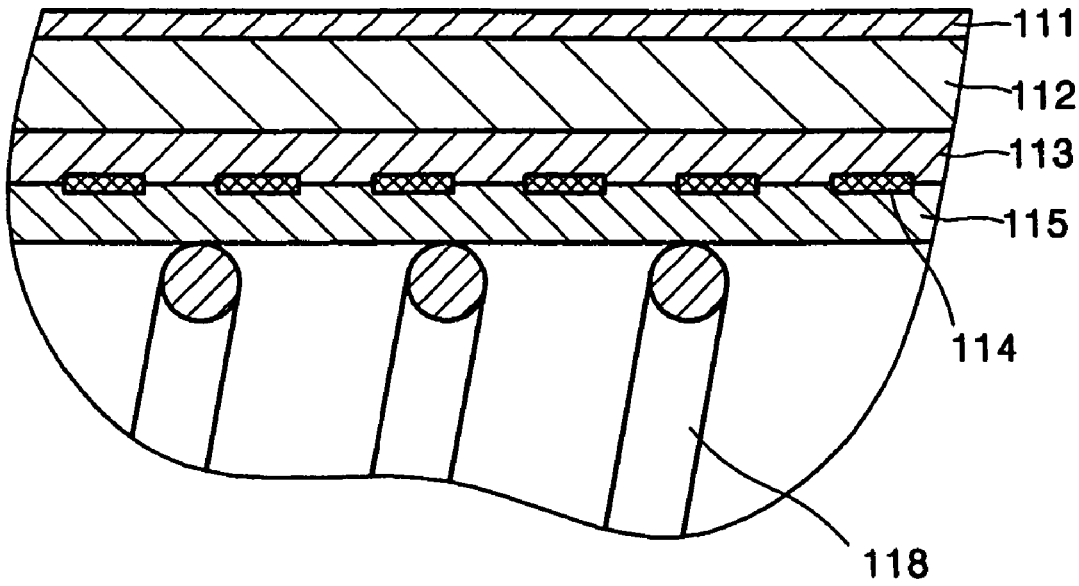
FIG. 4 is a partially enlarged view of a part of the fusing apparatus shown in FIG. 3.
Figure 5:
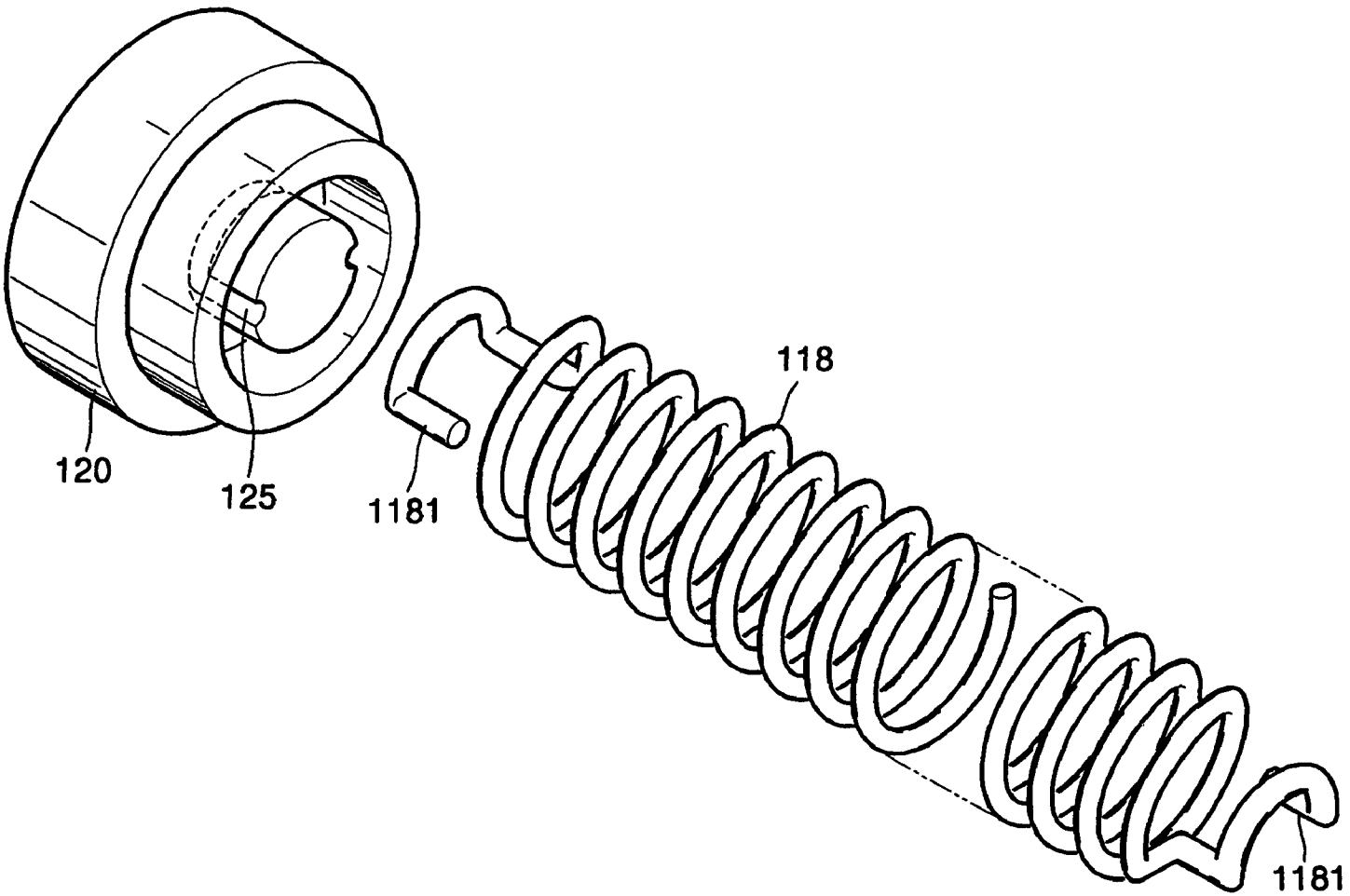
FIG. 5 is an exploded perspective view of a an adhering unit of a fusing roller according to an exemplary embodiment of the present invention.

Referring to FIGS. 3 through 5, a fusing apparatus 100 includes a fusing roller 110 that generates heat to fuse a toner image onto paper, and a pressing roller 130 facing the fusing roller 110 and contacting the fusing roller 10 in an axial direction thereof to press the paper passing between the fusing roller 110 and the pressing roller 130 toward the fusing roller 110.

The pressing roller 130 has a cylindrical body 131 that is rotatably supported by a shaft 133. A coating layer 132 is formed on an outer circumferential surface of the body 131 for improving a fusing property of the toner image. If necessary, a fusing roller may be used instead of using the pressing roller to transmit the heat while pressing the paper.

The fusing roller 110 includes a heating roller unit 112, a coil unit 114, and an adhering unit 118.

The heating roller unit 112 is formed of a magnetic substance that has a cylindrical shape with an empty inner space 117. A coating layer 111, preferably formed of tetrafluoruethylene, is formed on a surface of the heating roller unit 112 for improving the releasing property with the toner image. The heating roller unit 112 is magnetized by an electromagnetic field, and has a conductive property so that a predetermined amount of electric current flows therethrough. Preferably, the heating roller unit 112 is formed of Fe alloy, Cu alloy, Al alloy, Ni alloy, or Cr alloy, for example.

The coil unit 114 is installed to be adhered in a spiral shape to the inner side of the heating roller unit 112, and generates an alternating magnetic flux that is changed in response to the current input from an external power source (not shown). Preferably, the coil unit 114 is formed using a ribbon coil of Cu.

A first insulating layer 113 is disposed between the coil unit 114 and the heating roller unit 112, and a second insulating layer 115 is disposed between the coil unit 114 and the adhering unit 118. Thus, a dielectric breakdown due to alternating current (AC) input into the coil unit 114 is not generated, and a leakage current does not flow to the heating roller unit 112 or to the adhering unit 118.

The first and second insulating layers 113 and 115 preferably have predetermined withstand voltage properties and dielectric breakdown resistance properties. The withstand voltage property means that the insulating layer withstands a predetermined power, and the dielectric breakdown resistance means that a leakage current should not exceed 10 mA for one minute under the maximum withstand voltage and that dielectric breakdown should not occur. The first and second insulating layers 113 and 115 may be formed of mica, polyimide, ceramic, silicon, polyurethane, glass, or polytetrafluoruethylene (PTFE).

The adhering unit 118 is installed in the space 117 in the heating roller unit 112 to adhere the coil unit 114 toward the heating roller unit 112, and is formed of an elastic material that elastically biases the coil unit 114 toward the heating roller unit 112.

Preferably, the adhering unit 118 is a non-magnetic material, since the induced heat is preferably generated on the heating roller unit 112, not on the adhering unit 118 by the alternating magnetic flux generated from the coil unit 114 to fuse the toner image on the paper.

Preferably, the adhering unit 118 is formed as a coil spring. Since the coil spring is formed of an elastic material, the adhering unit 118 elastically biases the coil unit 114 toward the heating roller unit 112 to adhere the coil unit 114 onto the heating roller unit 112. Additionally, since the adhering unit 118 is formed as a spiral in the coil unit 114, the area contacting the coil unit 114 is small, and neighboring coils are separated from each other. Thus, generation of induced heat due to the induced current of the coil unit 114 is substantially prevented.

Therefore, the adhering unit 118 may be modified variously if it is formed of an elastic material such that the coil unit 114 may be adhered toward the heating roller unit 112, and that induced heat is not generated by the induced current of the coil unit 114.

An end cap 120 and an end cap for transmitting driving power 121 are installed on both ends of the heating roller unit 112. The power transmission end cap 121 has a similar structure to that of the end cap 120, however, it includes a power transmission unit 124 such as a gear for connecting to a power apparatus (not shown) and rotating the fusing roller 110.

An air vent 122 is formed on the end cap 120. The air vent 122 flows air between the inner space 117 of the heating roller unit 112 and the outside after the end cap 120 is installed on the heating roller unit 112. Thus, the pressure of the inner space 117 may be maintained at the atmosphere pressure.

Therefore, even when the heating roller unit 112 is heated by the heat transmitted from the coil unit 114, the outer air may flow in the inner space 117 through the air vent 122 and the atmosphere pressure may be maintained. The air vent 122 may be formed on the power transmission end cap 121. Otherwise, the air vent 122 may be formed on both the end cap 120 and the power transmission end cap 121. Additionally, the air vent 122 is not an essential element.

Electrodes 123 are installed on the end cap 120 and the power transmission end cap 121. The electrode 123 is electrically connected to lead units 116 formed on both ends of the coil unit 114. The electric current input from the outside is supplied to the coil unit 114 after passing through the electrode 123 and the lead unit 116.

Fixation units 125 for fixing the adhering unit 118 are installed on the end cap 120 and the power transmission end cap 121. Referring to FIG. 5, the fixation unit 125 has recesses so that both ends 1181 of the adhering unit 118 may be inserted into the recesses. The fixation unit 125 is not limited to the shape shown in FIG. 5, however, and may be modified in any suitable manner to connect the adhering unit 118 to the end cap 120 and the power transmission end cap 121.

A heating process of the fusing roller having the above structure is as follows.

Figure 6:
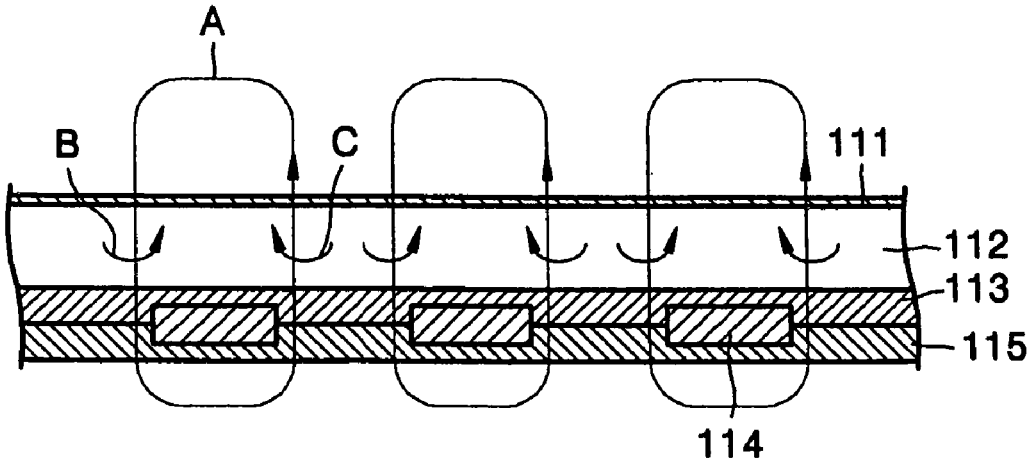
FIG. 6 is a schematic elevational view in partial cross section of heat generated by a heating roller unit due to an induction current in the fusing roller according to an exemplary embodiment of the present invention.
Figure 7:
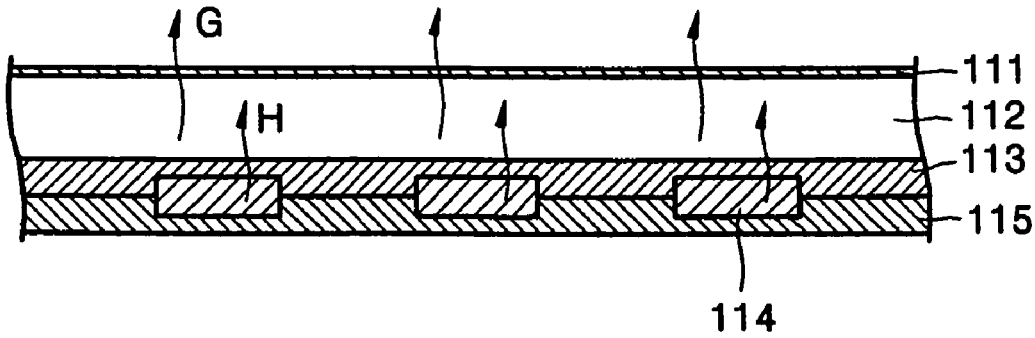
FIG. 7 is a schematic elevational view in partial cross section of a heating source that generates heat in the fusing roller according to an exemplary embodiment of the present invention.

Referring to FIGS. 3 and 6, when AC is input into the coil unit 114 from the power supplying unit (not shown), the coil unit 114 generates an alternating magnetic flux (A) denoted by a solid line in FIG. 6. The alternating magnetic flux (A) generated by the coil unit 114 crosses the heating roller unit 112, and generates induced currents B and C of different directions from each other from the heating roller unit 112 by the change of the alternating magnetic flux crossing the heating roller unit 112. Here, it is assumed that the current flows through the coil unit 114 in an upward direction from the ground.

Here, since the heating roller unit 112 has its own specific resistance, the induced currents B and C generate Joule heat G (hereinafter, referred to as induced Joule heat) on the heating roller unit 112. The induced Joule heat G is transmitted to the toner image through the protective layer 111 by the heating roller unit 112.

Additionally, since the coil unit 114 has the specific resistance, it is heated by the input AC and generates Joule heat H (hereinafter, referred to as resistance Joule heat). The resistance Joule heat H is transmitted to the toner image (not shown) through the first insulating layer 113, the coil unit 114, and the protective layer 111.

Thus, when the AC is input to the coil unit 114, the toner image transferred on the recording medium (not shown) is fused on the medium by the induced Joule heat G generated by the induced currents B and C of the heating roller unit 112 caused by the alternating magnetic flux A generated around the coil unit 114 and the resistance Joule heat H generated by the coil unit 114.

As described above, according to the fusing roller of an exemplary embodiment of the present invention, the adhering unit that is formed of the non-magnetic and elastic material elastically biases the coil unit onto the heating roller unit. Thus the coil unit is adhered to the heating roller unit, and the induced current is not generated on the adhering unit. Therefore, the magnetic flux is concentrated in the heating coil unit, and thereby the induced heating efficiency is improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A fusing roller for fusing an image on a printing medium, comprising:

a coil unit generating a magnetic flux with an alternating current;

a heating roller unit heated by an induced current generated by the magnetic flux; and an adhering unit to elastically bias the coil unit radially outwardly toward the heating roller unit to adhere the coil unit onto the heating roller unit.

2. The fusing roller of claim 1, wherein the coil unit is formed of a ribbon coil of Cu material.

3. The fusing roller of claim 1, wherein the coil unit is resistance heated by a predetermined alternating current.

4. The fusing roller of claim 1, wherein the adhering unit is formed of a nonmagnetic material and installed to contact the inside of the coil unit.

5. The fusing roller of claim 1, wherein the adhering unit is formed of an elastic material.

6. The fusing roller of claim 5, wherein the adhering unit is a coil spring.

7. The fusing roller of claim 1, wherein the heating roller unit has end caps installed on both ends thereof for sealing the heating roller unit; and fixation units are formed on the end caps for fixing both ends of the adhering unit.

8. The fusing roller of claim 7, wherein the fixation units have recesses in which both ends of the adhering unit are inserted.

9. A fusing apparatus, comprising:

a fusing roller generating heat for fusing an image onto a sheet of paper; and a pressing roller facing and contacting the fusing roller to adhere the paper toward the fusing roller, wherein the fusing roller includes a coil unit resistance heated by a predetermined alternating current and generating an alternating magnetic flux by the alternating current;

a heating roller unit heated by an induced current generated by the alternating magnetic flux; and an adhering unit formed of a non-magnetic material and installed to contact the inside of the coil unit to elastically bias the coil unit radially outwardly toward the heating roller unit to adhere the coil unit onto the heating roller unit.

10. The fusing apparatus of claim 9, wherein the adhering unit is formed of an elastic material.

11. The fusing apparatus of claim 9, wherein the adhering unit is a coil spring.

12. The fusing roller of claim 9, wherein the coil unit is formed of a ribbon coil of Cu material.

13. The fusing apparatus of claim 9, wherein the heating roller unit has end caps installed on both ends thereof for sealing the heating roller unit, and fixation units are formed on the end caps for fixing both ends of the adhering unit.

14. The fusing apparatus of claim 13, wherein the fixation unit has recesses in which both ends of the adhering unit are inserted.

15. An image forming apparatus, comprising:

a photoconductive member to form an image;

a developing unit to develop the image;

a transfer unit to transfer the image onto a printing medium; and a fusing roller for fusing an image on the printing medium, the fusing roller including a coil unit generating a magnetic flux with an alternating current;

a heating roller unit heated by an induced current generated by the magnetic flux; and an adhering unit to elastically bias the coil unit radially outwardly toward the heating roller unit to adhere the coil unit onto the heating roller unit.

16. The image forming apparatus of claim 15, wherein the heating roller unit has end caps installed on both ends thereof for sealing the heating roller unit; and fixation units are formed on the end caps for fixing both ends of the adhering unit.

17. The image forming apparatus of claim 15, wherein the coil unit is resistance heated by a predetermined alternating current.

18. The image forming apparatus of claim 15, wherein the adhering unit is formed of a nonmagnetic material and installed to contact the inside of the coil unit.

19. The image forming apparatus of claim 15, wherein the adhering unit is formed of an elastic material.

20. The image forming apparatus of claim 19, wherein the adhering unit is a coil spring.

* * * * *